United States Patent [19]

Jaffa

[11] 3,961,388

[45] June 8, 1976

[54] METHOD AND APPARATUS FOR EFFECTING TRANSFER PRINTING

[75] Inventor: David Jaffa, Fairlawn, N.J.

[73] Assignee: Precision Screen Machines Inc., Hawthorne, N.J.

[22] Filed: Jan. 3, 1975

[21] Appl. No.: 538,358

[52] U.S. Cl. ..... 8/2.5 R; 8/62; 68/5 B; 101/470; 101/260

[51] Int. Cl.[2] ..... D06P 1/00; D06P 5/15; B41M 1/08

[58] Field of Search ..... 101/224, 225, 256, 257, 101/260, 272; 8/2.5; 68/5

[56] References Cited

UNITED STATES PATENTS

| | | | |
|---|---|---|---|
| 1,747,662 | 2/1930 | Cox et al. | 101/256 |
| 2,740,895 | 4/1956 | Miller | 101/470 X |
| 3,601,299 | 8/1971 | Murer | 101/118 X |
| 3,610,147 | 10/1971 | Crissy et al. | 101/228 |
| 3,620,881 | 11/1971 | Kanneglesser et al. | 101/470 |
| 3,827,356 | 8/1974 | Snow | 101/272 |

FOREIGN PATENTS OR APPLICATIONS

| | | | |
|---|---|---|---|
| 1,227,681 | 4/1971 | United Kingdom | 101/470 |

*Primary Examiner*—Clyde I. Coughenour
*Attorney, Agent, or Firm*—Philip D. Amins

[57] ABSTRACT

A method and apparatus for effecting the transfer printing of discrete cut-pieces of goods on a continuously rotating, drum type, transfer printer. The method and apparatus includes a rotary drum printer in which the rotary drum is reciprocally moved toward and away from a feed station in which the discrete goods are fed onto a continuous web of material having a transfer print thereon. The arrangement is such that when the drum is moved away from the feed station, the web and cut pieces thereon are indexed a corresponding amount, and when the rotating drum is moved toward the feed station, the web is held relatively motionless, thereby permitting the feeding of discrete cut-pieces thereon, permitting the drum to continue rotating to effect the transfer printing of the cut pieces previously fed into the web.

10 Claims, 4 Drawing Figures

METHOD AND APPARATUS FOR EFFECTING TRANSFER PRINTING

PROBLEM & PRIOR ART

Heat transfer printing or sublimation printing as used herein is defined as the printing on cloth or paper by utilizing a web having formed thereon a transfer print whereby the transfer print on the web is transferred onto the receiving cloth or paper by placing the cloth or paper to be printed, contiguous or in overlying relationship with the transfer print, and thereafter, applying heat and pressure thereto. Heretofore such transfer type of printing has been done on drum type rotary type of transfer printer. Characteristic of a rotary drum type transfer printer is that the drum is required to rotate at a continuous rate of speed, and for this reason such drum type printers had particular applications for effecting the high speed printing of continuous web type material. As a result such drum type printers were retracted in application to printing such articles as wallpaper or cloth which could be fed to the rotary printer from a roll of continuous web. Heretofore such drum type printers which could effect continuous printing at a relative rapid rate of speed could not be satisfactorily used for printing discrete cut-pieces of cloth or paper. This was because such cut-pieces had to be accurately fed onto the transfer print and such feeding was generally manually performed. For this reason, it was virtually impossible to effect the proper feeding of such cut-pieces in a manner to keep up with the printing speed of the drum printer. Also because the transfer print web on which the cut-pieces had to be fed was traveling at a considerable speed, workers performing the feeding operation developed symptoms of motion sickness. Because the printing operation could not be interrupted when printing with a rotary drum type printer, intermittent feeding of cut-pieces to a rotary printer was not feasible. For these reasons, it was not heretofore possible to attain the high speed printing of discrete cut-pieces which was otherwise possible with a rotary type drum transfer printer.

OBJECTS

An object of this invention is to provide a method and apparatus whereby the transfer printing of discrete cut-pieces can be effected at high printing speeds attainable by rotary drum type transfer printers.

Another object of this invention is to provide a method and apparatus whereby discrete cut-pieces of material can be readily fed intermittently onto a transfer print without interrupting the continuous transfer printing being effected by the rotary drum printer.

Another object is to provide an improved rotary drum type printer which is relatively simple in construction and positive in operation.

Another object is to provide a drum type transfer printer which is equally capable of printing either a continuous web or discrete cut-pieces at substantially the same operating speeds.

BRIEF SUMMARY OF INVENTION

The foregoing objects, features and other advantages are attained by a method of printing discrete cut-pieces of goods in a rotary drum type printer which includes the steps of first feeding a continuous web having a heat transfer print to the drum of a rotary transfer printer. The drum is then moved a predetermined amount in the direction of feed as the drum rotates a predetermined distance to index the web accordingly and to advance the cut-piece fed thereon to the drum printer. As the drum continues to rotate and upon termination of the indexing movement, the drum is returned in a direction opposite to the direction of index or feed, a corresponding amount. As the drum is returning, the web containing the transfer print is maintained relatively stationary. The timing of the return of the rotary drum is such as to permit sufficient time for an operator to feed the desired cut-pieces onto the web during this interval. This is attained by returning the drum toward the feed station at a rate of speed substantially equal to the rotational speed of the drum.

The foregoing method can be practiced by a drum type printer wherein the printing drum is mounted on a carriage feed station. A drive means in the form of a drive shaft and a connected drive motor is provided to effect the rotation of the drum to effect the feeding and printing of the discrete cut-pieces. Operatively associated with the drive shaft of the drum printer is a drive for effecting the reciprocal movement of the carriage and drum carrier thereby toward and away from the feed station.

The arrangement is such that as the drum continuously rotates to effect the continuous printing operation, the drum is also continuously reciprocated between predetermined limits. As a result, the web material which is continuously being fed about the periphery of the drum to effect the printing operation is held relatively motionless to the printing drum as the drum is returning toward the feed station. The portion of the transfer print web at the feed station is thus subjected to relative intermittent motion, thereby permitting an operator to accurately feed discrete cut-pieces onto the transfer print web during the interval it is motionless relative to the linear movement of the drum.

FEATURES

A feature of this invention resides in the provision of moveably mounting a transfer drum of a transfer printer for reciprocal movement relative to a feed station so that continuous printing can be effected as the web and cut-pieces thereon are intermittently advanced relative to the moving drum.

Another feature resides in the provision of moveably mounting the rotating drum of a transfer printer relative to a feed station whereby cut-pieces of goods can be fed at a rate to maintain the high speed efficiency of a rotary transfer printer.

Other features and advantages will become more readily apparent when considered in view of the drawings and specification in which.

DETAILED DESCRIPTION

Figure 2:
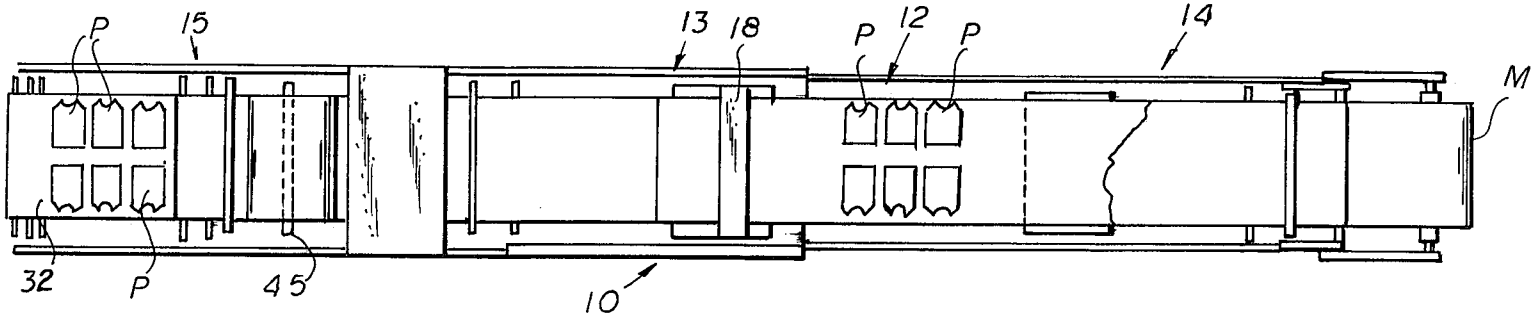
FIG. 2 is a top plan view of the printer of FIG. 1.

The present invention is directed to an improved method for effecting the printing of discrete cut-pieces of goods by sublimation or heat transfer on a continuously rotating drum type printer. This is attained by feeding a continuous web having a transfer print thereon through a feed station and onto the transfer drum of a sublimation printer. The goods or cut-pieces to be printed are fed and positioned onto the continuous web at the feed station whereby the cut-pieces and web are advanced in unison to the drum whereby the application of heat and pressure in traveling about the periphery of the drum effects the transfer of the print from the web onto the cut-pieces. Transfer printing utilizing a drum type sublimation printer inherently requires that the web containing the transfer print and the material to be printed be in continuous motion as it travels under heat and pressure about the periphery of the transfer drum to effect the desired or optimum print or transfer. Also because such drum type printers operate at considerable speed, it has been heretofore difficult for operators to properly feed cut-pieces onto the web at a rate comparable to the operating speed of the drum type sublimation printer.

To obviate this difficulty, and to provide a proper feed interval for feeding cut-pieces of goods onto the web which requires constant movement about the periphery of the drum, and without retarding or reducing the speed, the present method contemplates the reciprocation of the transfer drum in a linear direction toward and away from the feed station at a linear rate which in operation causes the portion of the web passing through the feed station to be intermittently advanced relative to the moving drum without retarding or interfering with the speed at which the web and cut-pieces are advanced about the periphery of the drum to effect the printing operation. In the interval that the web is motionless relative to the rotating drum, the cut-pieces can be easily fed onto the web. This is rendered possible in that as the rotating drum is moved linearly away from the feed station, it will cause the web and cut-pieces fed thereon to be indexed a predetermined amount. As the drum is returned toward the feed station, preferably at a rate of speed which is substantially equal to the rotational speed of the drum, the previously indexed portion of the web provides a slack which in effect is taken up by the drum on its return toward the feed station. During this interval, the portion of the web at the feed station is thus motionless, permitting the feeding of cut-pieces to be effected, without interfering with the operating feed of the drum printer, or the printing operation.

The drawing illustrates an apparatus by which the method described can be readily utilized to sublimation print a continuous sheet of material or discrete cut-pieces of material as described by the foregoing method. The illustrated apparatus 10 comprises a frame 11 formed of suitable structural members which includes a feed station 12, a printing station 13, an unwinding stand portion 14 and a winding or take up stand portion 15.

Figure 3:
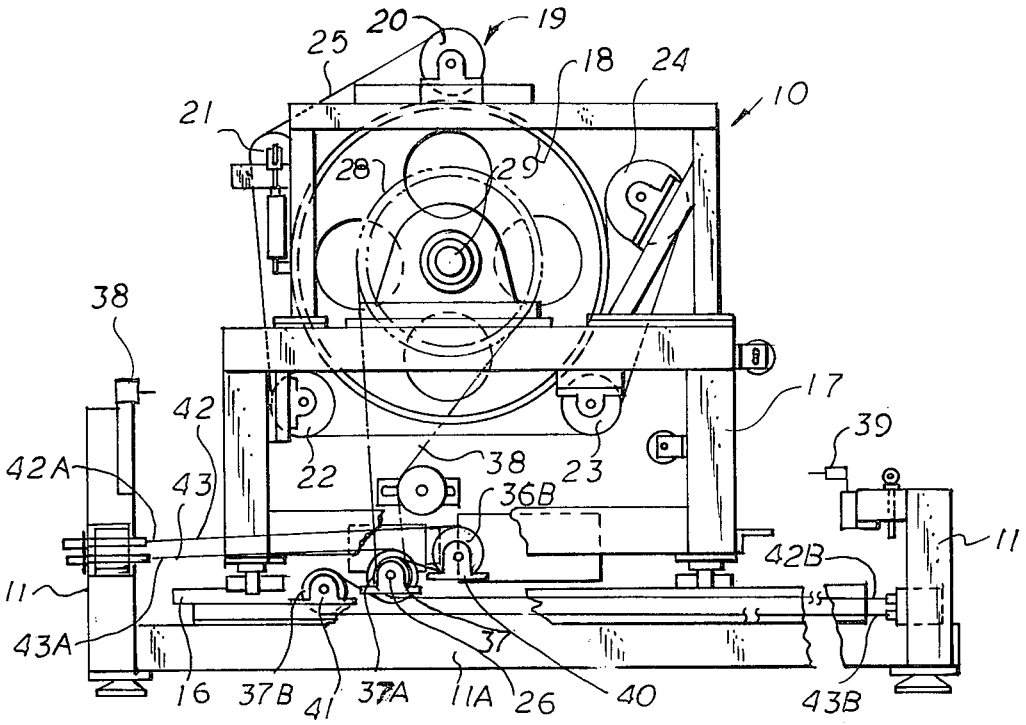
FIG. 3 is an enlarged side elevational view of the drum printing portion.
Figure 4:
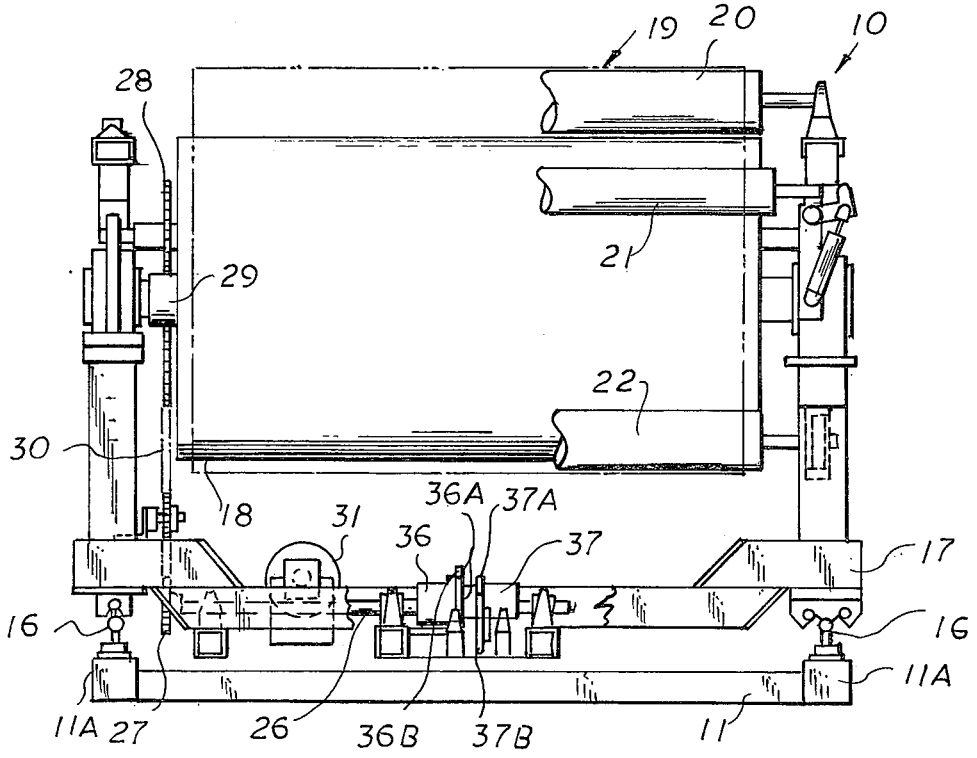
FIG. 4 is a front elevational view of the drum printing portion of FIG. 3; having parts thereof broken away.

As best seen in FIGS. 3 and 4, the printing station includes a pair of opposed rail members 16—16 which are supported on the bottom members 11A of frame 11. Slidably supported on rail members 16—16 is a carriage or carriage superstructure which supports the transfer drum 18 of the sublimation printer 19. As will be hereinafter described, the sublimation printer 19 is mounted on the rail members 16—16 for linear reciprocal movement toward and away from the feed table 12A at the feed station 12.

The sublimation printer 19, as illustrated, comprises a transfer drum 18 which is rotatably supported on the carriage 17. A plurality of guide rollers 20, 21, 22, 23 and 24 are circumferentially spaced about the drum 18, each roller 20 – 24 being suitably journalled on the carriage superstructure 17. Threaded about the drum 18 and each of the rollers 20 – 24 is an endless pressure belt 25 which circumscribes a major portion of the periphery of the drum 18.

A drive means is provided for effecting the rotation or drive of the drum 18 about its axes of rotation. The drum drive means includes a drive shaft 26 which has connected thereto an end sprocket 27. A complementary driven sprocket 28 is connected to the drum axle 29. A flexible drive member or chain 30 is threaded about sprockets 27 and 28 to connect sprocket 27 in driving relationship with sprocket 28. To effect the rotation of the drive shaft 26, a suitable power source, e.g., an electric motor 31 is operatively connected in driving relationship to the drive shaft 26. It will be thus apparent that when motor 31 is energized the transfer drum 18 is placed in rotation.

Figure 1:
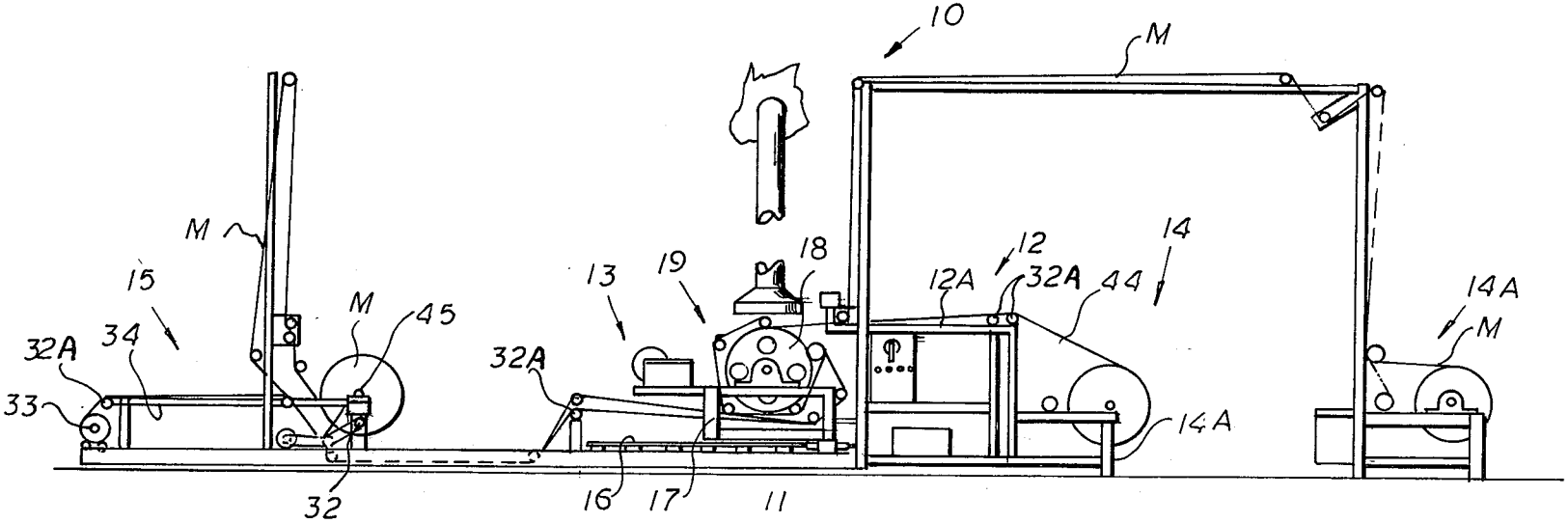
FIG. 1 is a side elevational view of a drum type transfer printer embodying the present invention.

As seen in FIGS. 1 and 2, a portion of the unwind station 14 includes an unwind support 14A for supporting a roll of web material or paper 32 which contains the transfer print. Accordingly, the free end of the transfer paper 32 is passed over the top of the feed table 12A, about the periphery of the drum 18, and over a series of suitable guiding rollers 32A to a take up or rewind roller 33 located in the rewind portion 15 of the apparatus. Adjacent the rewind roller 33 the web 32 carrying the printed cut-pieces "P" pass over a take off table 34 where the printed pieces P can be readily removed either manually or mechanically. It will be understood that suitable heaters are provided for maintaining the drum 18 at proper operating temperatures. The printing station 13 may also utilize a drum type sublimation printer 18 as more particularly described in copending application, Ser. No. 517,447, filed Oct. 24, 1974 for Drum Type Sublimation or Transfer Printing Apparatus.

In accordance with this invention, a means is provided to effect reciprocal movement of the printer 19 relative to the feed station 12 during the printing operation of discrete cut-pieces of goods P. This is accomplished by a pair of clutch assemblies 36 and 37 which are operatively connected to the drive shaft 26. The respective clutches are actuated by suitable micro switches 38, 39 or similar actuators mounted on the frame 11. The respective micro switches 38, 39 are disposed so as to be actuated by the carriage 17 as the carriage approaches the limit of its travel in either direction.

Each of the respective clutches includes a driving gear 36A and 37A, respectively. Complementing each of the driving gears 36A and 37A of the respective clutches 36 and 37 and idler gears 36B and 37B, each being journalled in bearings or journals 40 and 41, respectively, fixed to the carriage. Stretched between opposed portions of the frame 11 are guide chains 42 and 43.

As best seen in FIG. 3, one end 42A of chain 42 is fixed adjacent the upright of the frame 11 and the other end 42B is fixed to an opposed upright frame 11. An intermediate portion of chain 42 is threaded about idler gear 36B and the driving gear 36A of clutch 36. Opposed ends 43A and 43B of chain 43 are likewise fixed to the adjacent opposed uprights of the frame 11 with the intermediate portion of chain 43 threaded about idler gear 37B and the driving gear 37A of clutch 37. As will be hereinafter described, the arrangement is such that when one clutch is actuated to effect the drive of the printer 19 in one direction, the other clutch is rendered free wheeling relative to the drive shaft 26. Thus by alternately actuating the respective clutches 36 and 37, the printer carriage 17 and printer 19 are reciprocated along rail 16—16 toward and away from the feed table 12A.

The respective clutches 36 and 37 are operatively connected to micro switches 38 and 39 so that as the carriage reaches the limits of its travel in one direction, it will actuate the adjacent micro switch which will energize the appropriate clutch to effect the movement of the carriage in the opposite direction. For example, when clutch 37 is actuated by the carriage engaging switch 38, the carriage is being driven toward the feed table 12A. When the carriage and printer engage switch 39, clutch 36 is activated and clutch 37 deactivated, whereby the carriage and printer are shifted away from the feed table or to the left as viewed in FIGS. 1 and 2. Thus, the actuation of the respective clutch 37 or 37 will cause the respective driving gear thereof to travel along the corresponding chain threaded therearound to effect the linear drive of the carriage 17 accordingly.

With the structure thus described, the operation of the apparatus 10 is as follows:

With a supply of print transfer paper 44 located at the unwind station 14, the lead end thereof is fed to the drum printer and about the take up roll 33. With the drive motor 31 energized, the drum 18 is rotated to feed the print web 44 toward the printer 18. Accordingly, when micro switch 39 is actuated, clutch 36 is actuated so that the drum printer is shifted to the left or away from the feed station 12 as best seen in FIG. 1. In doing so, the web 44 is indexed in the direction of feed a corresponding amount. Since the cut-pieces P have been fed onto web 44, the web and cut-pieces P are advanced in unison toward the drum 18. As the drum reaches the end of its index; i.e., the extreme left as viewed in FIG. 1, it will actuate micro switch 38 causing clutch 37 to be engaged in driving relationship to the drive shaft 26 while effecting disengagement of clutch 36. When this occurs, the printer 18 is driven toward the feed table or to the right as seen in FIG. 1. When this occurs, the slack or index portion of the web 44 is fed about the periphery of the drum to effect the printing. A relative movement is thus effected whereby on the return of the drum toward the feed table 12A, the portion of the web 44 over the table is maintained relatively motionless. During this interval, an operator can readily feed the requisite cut-pieces P onto the web overlying the feed table.

When the printer 19 has advanced to the extreme right, as viewed in FIG. 1, the micro switches are actuated to reverse the operation of the respective clutches to repeat the cycle. To insure a relative motionless movement of the web portion of the feed station 12A during the feeding interval, the return of the drum printer is timed so that the linear movement to the right is rendered substantially equal to the rotational speed of the drum 18.

The arrangement described thus provides for relative intermittent motion of the web 44 at the feed station and continuous movement in traveling about the periphery of the drum 18 so as to ensure continuous printing. Thus, the intermittent movement of the web 44 at the feed station insures adequate feed time for locating the cut-pieces P properly onto the print web.

The apparatus described can be readily utilized to print a continuous sheet or roll of material M. This is accomplished by locating a supply of continuous material to be printed at an unwind station 14A and threading the material M over suitable guide rollers and into overlying position with web 44. The two continuous webs 44 and M are passed in unison about the drum to effect the print. However, when printing continuous material, the clutch drives are both rendered inoperative so that any linear movement of the printer 19 relative to the feed station is prohibited.

Upon passing about the rotating drum, the respective exhausted print web 44 and printed web M are guides to their respective take up rollers 33 and 45.

With the apparatus described, it will be noted that it can be readily adapted to print either discrete cut-pieces or a continuous web with equal speed. In printing discrete cut-pieces, the respective clutch drives are alternately activated to provide a relatively motionless feed interval of the web 44 at the feed station 12, without any attendant interruption in the printing of the previously fed cut-pieces. When the apparatus is desirous of being used to print a continuous web M, the drum printer is maintained fixed during the printing operation.

While the invention has been described with respect to a particular embodiment thereof, it will be appreciated and understood that variations and modifications may be made therein without departing from the spirit and scope of the invention.

What is claimed is:

1. A rotary printer for effecting transfer printing comprising a transfer drum, an endless pressure belt threaded about a peripheral portion of said drum, a web having a transfer print thereon, means for effecting the continuous rotation of said drum for continuously feeding said web into printing relationship to the periphery of said drum to effect a transfer print, and means for effecting linear reciprocal movement of said drum and effecting indexing of said web as said drum is moved in the direction of feed of said web and maintaining said web relatively stationary on said drum as the same is moved in a direction opposite to the direction of feed of said web.

2. The invention as described in claim 1, wherein said means for effecting linear reciprocal movement moves said drum in a direction opposite to the feed of said web at a rate substantially equal to the peripheral rotational speed of said drum.

3. The invention as defined in claim 1, wherein said means for effecting continuous rotation of said drum includes a drive shaft, motor means for effecting the drive of said drive shaft, and means for connecting said drum in driving relationship with said drive shaft, said means for effecting linear reciprocal movement including a pair of clutches operatively connected to said drive shaft, a flexible drive member operatively connected with each of said clutches, and means for alternately actuating the respective clutches for advancing the drum in the direction of feed and in a direction opposite to said feed as said clutches are alternately actuated.

4. A rotary transfer printer for printing discrete cut-pieces comprising a rotatably journalled transfer drum, an endless pressure belt threaded about a peripheral portion of said drum, means for effecting the continuous rotation of said drum whereby a continuous web having a transfer print thereon is fed into contact with the periphery of said drum, a feed station at which discrete cut-pieces are fed onto said web prior to feeding said web between the periphery of said drum and said pressure belt, and means for effecting the movement of said drum toward and away from said feed station as said drum continuously rotates whereby said web and cut-pieces are indexed toward said drum as said drum moves away from said feed station and as said drum continuously rotates, and whereby said web is maintained stationary relative to said feed station as said drum moves toward said feed station to facilitate feeding of said discrete cut-pieces onto said web at said feed station.

5. A rotary transfer printer for effecting the transfer printing of discrete cut-pieces comprising a frame, a carriage mounted on said frame, a rotary transfer drum mounted on said carriage, an endless pressure belt threaded about a peripheral portion of said drum, a web having a transfer print thereon, means for effecting the rotation of said transfer drum to cause said web to be fed into contact with the periphery of said drum, a feed station at which discrete cut-pieces are fed onto said web, and means for effecting relative linear movement between said carriage and said frame to cause said carriage to be alternately moved relative to said frame in a direction away from said feed station for indexing said web and cut-pieces, and toward said feed station to maintain said web relatively fixed at said feed station during the feeding of said discrete cut-pieces onto said web.

6. The invention as defined in claim 5, including a plurality of guide rollers spaced about said drum, said pressure belt being threaded about said guide rollers and said drum whereby said belt circumscribes a major peripheral portion of said drum, means for heating the peripheral surface of said drum, said means for continuously rotating said drum comprising a drive shaft, motor means connected in driving relationship to said drive shaft, means connecting said drive shaft in driving relationship with said drum, said means for effecting relative linear movement of said drum relative to said frame comprising a pair of clutch means operatively associated with said drive shaft, and means for alternately engaging and disengaging said clutches from said drive shaft whereby said carriage and drum supported thereon are reciprocated toward and away from said feed station accordingly.

7. The invention as defined in claim 1, including a rotary guide fixed to said frame operatively associated with each of said clutches, a flexible drive having its opposed ends fixed to said frame and having an intermediate portion threaded over said rotary guide and associated clutch whereby the actuation of one of said clutches causes said carriage and drum thereon to be driven along the operative flexible drive.

8. A method of sublimation printing discrete cut-pieces of goods on a rotary drum printer comprising the steps of continuously feeding a web having a heat transfer print thereon to a rotary drum printer as said drum rotates, effecting the movement of said drum in the direction of feed a predetermined amount to index said web a corresponding amount as the drum rotates, and returning the drum in a direction opposite to the direction of feed upon completion of the indexing movement as the drum of said printer continues to rotate to thereby effect a transfer print.

9. The method as defined in claim 8, including the step of returning said drum at a rate of speed substantially equal to the peripheral rotational speed of said drum.

10. The invention as defined in claim 8, including the step of feeding the cut-pieces onto the web as the drum is returned in the direction opposite to the direction of feed.

* * * * *